US005300012A

United States Patent [19]

Kamada

[11] Patent Number: 5,300,012

[45] Date of Patent: Apr. 5, 1994

[54] UNCURLING DEVICE

[75] Inventor: Takeshi Kamada, Atsugi, Japan

[73] Assignee: Ricoh Company, Ltd., Tokyo, Japan

[21] Appl. No.: 942,032

[22] Filed: Sep. 8, 1992

[30] Foreign Application Priority Data

Sep. 6, 1991 [JP] Japan ..... 3-226262

[51] Int. Cl.[5] ..... B65H 23/34

[52] U.S. Cl. ..... 493/459; 493/460; 162/271

[58] Field of Search ..... 493/459, 460, 461; 162/271

[56] References Cited

U.S. PATENT DOCUMENTS 4,505,695 3/1985 Billings ..... 493/459
4,977,432 12/1990 Coombs et al. ..... 162/271
5,123,895 6/1992 Mandel ..... 493/459

*Primary Examiner*—William E. Terrell
*Attorney, Agent, or Firm*—Oblon, Spivak, McClelland, Maier & Neustadt

[57] ABSTRACT

A device incorporated in a facsimile transceiver or similar recording apparatus of the type using a roll of paper for removing the curl of the paper. The device has a regular transport path, an uncurl transport path, and a separator fixed in place at a position where the two transport paths branch off. The separator steers the paper to either of the two transport paths on the basis of the height of a curl existing at the leading edge of the paper. The separator has a generally triangular configuration which has an apex at the center in the widthwise direction perpendicular to an intended direction of paper transport and inclines from the apex toward opposite ends. As a result, the paper is admitted into the regular transport path or the uncurl transport path little by little from part of the leading edge thereof.

9 Claims, 2 Drawing Sheets

UNCURLING DEVICE

BACKGROUND OF THE INVENTION

The present invention relates to an uncurling device incorporated in a facsimile transceiver or similar recording apparatus of the type using a paper roll for removing curls of the paper and, more particularly, to an uncurling device operable on the basis of the height of a curl.

It is a common practice with a facsimile transceiver, printer or similar recording apparatus to use a rolled paper. Since the rolled paper curls in the rolling direction, an uncurling device for removing the curl of the paper is incorporated in the recording apparatus. Uncurling devices of the type curling a paper with a curl in the opposite direction to the curl are disclosed in, for example, Japanese Utility Model Publication No. 33882/1988, Japanese Patent Laid-Open Publication Nos. 88270/1990, 88271/1990, and 88272/1990. The problem with this type of uncurling device is that it uncurls a paper unconditionally with no regard to the degree of a curl and, therefore, causes a paper with a small curl to curl in the opposite direction.

In the light of the above, uncurling devices capable of uncurling a paper by a variable amount matching the varying diameter of the paper roll and the weight of the paper are taught in, for example, Japanese Patent Publication No. 57019/1989, Japanese Patent Laid-Open Publication Nos. 285556/1989 and 16969/1987, and Japanese Utility Model Publication No. 119547/1986. However, since this type of uncurling device changes the uncurling amount, the structure is complicated and, since a movable uncurling section is essential, the reliability is low. During the uncurling operation, the device rubs the imaged surface of the paper to lower the image quality. Moreover, even when the roll diameter is the same, the degree of a curl depends on the paper property, print pattern, temperature and so forth, making the uncurling amount excessive or short. This is also apt to curl the paper in the opposite direction if the degree of the curl is low. In addition, this type of uncurling device is operable only with a paper in the form of a roll and not applicable to documents and cut sheets.

The uncurling device may be so constructed as to determine the degree of a curl of a paper and uncurl the paper in matching relation to the curl, as disclosed in Japanese Patent Laid-Open Publication Nos. 124463/1986 and 48343/1981 by way of example. This kind of uncurling device, however, needs a curl sensor for determining the amount of a curl, and a movable separator for changing the uncurling amount, resulting in a disproportionate cost.

SUMMARY OF THE INVENTION

It is therefore an object of the present invention to provide a simple and inexpensive uncurling device which determines the degree of a curl by a fixed separator and removes only curls greater than a predetermined degree.

It is another object of the present invention to provide an uncurling device which has a regular transport path and an uncurl transport path disposed above the regular transport path so as to select either of them on the basis of the height of the leading edge of a paper curled upward.

It is another object of the present invention to provide an uncurling device which has a triangular fixed separator for guiding a paper into either of a regular and an uncurl transport path little by little from part of the leading edge of the paper, thereby eliminating a jam at the position where the two transport paths branch off.

It is another object of the present invention to provide an uncurling device which facilitates the entry of a paper into an uncurling section by a drive roller preceding the uncurling section.

It is another object of the present invention to provide an uncurling device capable of enhancing neat stacking of papers by stacking an uncurled paper on a paper exit of a regular transport path.

A device for uncurling a paper of the present invention comprises a regular transport path for transporting the paper without uncurling, an uncurl transport path for transporting the paper for uncurling the paper, an uncurling section located on the uncurl transport path, and a fixed separator for steering the paper to either of the regular transport path and uncurl transport path on the basis of the height of a curl existing at the leading edge of the paper.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
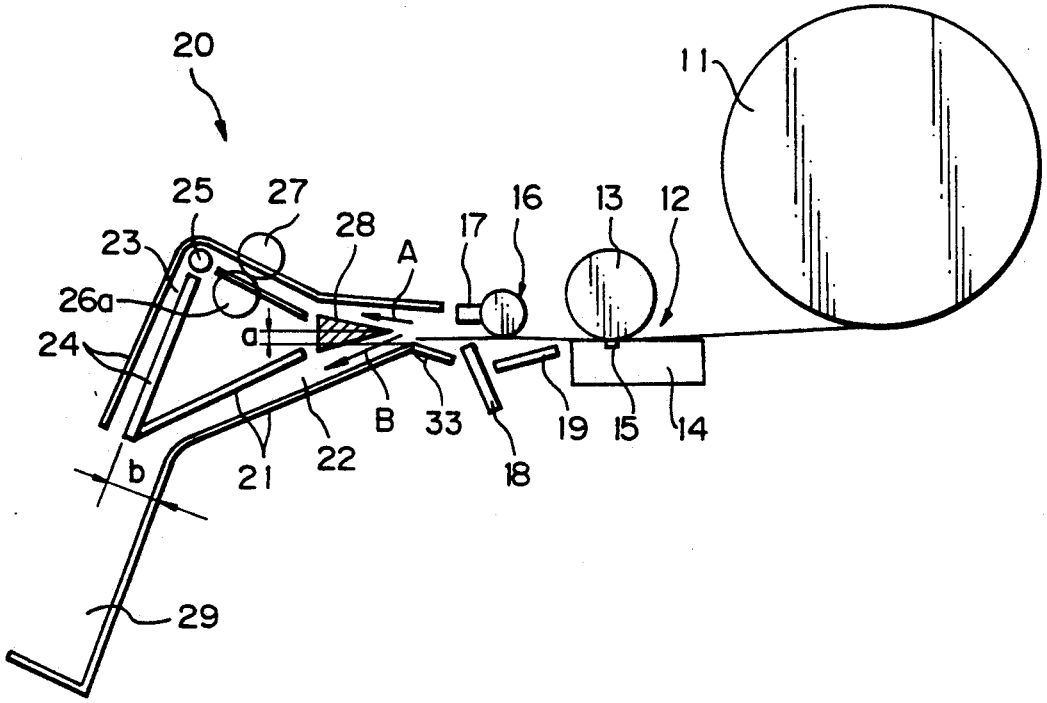
FIG. 1 is a facsimile transceiver to which an uncurling device embodying the present invention is applied.

Referring to FIG. 1 of the drawings, there is shown a recording section and a transporting section forming part of a facsimile transceiver to which an uncurling device embodying the present invention is applied. A paper 11 is paid out from a roll accommodated in a predetermined position. The recording section, generally 12, has a feed roller 13 and a thermal head 14 which is provided with a heating element 15 for thermally printing data on the paper 11. A cutter 16 has a rotary edge 17, a stationary edge 18, and a guide 19. The rotary edge 17 is rotatable to cut the paper 11 in a predetermined length.

Figure 2:
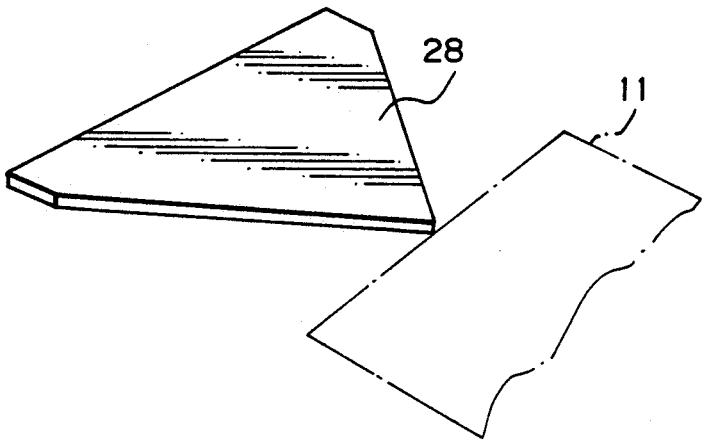
FIG. 2 is a perspective view of a fixed separator included in the embodiment.

The uncurling device, generally 20, has a regular transport path 22 formed by guides 21, and an uncurl transport path 23 defined above the regular transport path 22 by guides 24. The uncurl transport path 23 includes an uncurling section 25, and rollers 26 and 27 for driving the paper 11 into the uncurling section 25. A separator 28 is fixed in place at a position where the two transport paths 22 and 23 branch off. As shown in FIG. 1, a support portion 33 is provided downstream of the feed roller 13 and upstream of the separator 28. The support 33 is slightly inclined in the direction of movement of the paper. The separator 28 steers the paper 11 to either of the transport paths 22 and 23, depending on the height of a curl which exists at the leading edge of the paper 11. Specifically, as shown in FIG. 2, the separator 28 has a generally triangular configuration which has an apex at the center in the widthwise direction perpendicular to the direction of paper transport and inclines from the apex toward opposite ends. With such a configuration, the separator 28 causes the paper 11 to sequentially enter either of the transport paths 22 and 23.

As stated above, the illustrative embodiment determines whether or not the paper 11 should be uncurled on the basis of the height of a curl by the separator 28 and uncurls the paper 11 only if the curl is higher than a predetermined height. This eliminates the need for a curl sensor and a movable separator which are expensive, thereby reducing the cost of the uncurling device.

Further, the embodiment directly determines the degree of a curl by use of the fixed separator 28 having a simple configuration. Therefore, the uncurling operation is free from the influence of roll diameter, paper property, print pattern, temperature and so forth and, hence, accurate. It follows that the embodiment is also applicable to the uncurling of cut sheets.

It is to be noted that the embodiment is capable of determining the degree of a curl with accuracy if the curled surface faces upward. When the curled surface faces downward, the height of a curl changes due to the weight and elasticity of paper and, therefore, cannot be accurately determined. The embodiment performs an accurate uncurling operation by selecting either of the transport paths 22 and 23 on the basis of the height of a curl.

The papers 11 cut and come out of the regular transport path 22 or the uncurl transport path 23 are sequentially stacked on a stacker 29. Assume that the paper 11 to be admitted into the regular transport path by the separator 28 has a curl having a height a at the leading edge thereof, and that the difference in level between the uncurl transport path 23 and the stacker 29 is b. Then, the difference in level b is selected to be greater than the sum of the height a and the thickness of the maximum number of papers that can be stacked on the stacker 29. Specifically, an uncurled paper is stacked on a paper exiting from the regular transport path 22 and existing on the stacker 29. This enhances neat stacking since, for example, a paper driven out of the regular transport path 22 and slightly curled is pressed from above by an uncurled paper and, therefore, laid flat on the stacker 29.

In operation, the heating element 15 intervening between the thermal head 14 and the feed roller 13 prints one line of data on the paper 11 at a time. The cutter 16 cuts the paper 11 in a predetermined length with the rotary edge 17 and stationary edge 18. The cut paper 11 is transported to the uncurling device 20. If the curl at the leading edge of the paper 11 is lower than the height a, it is steered in a direction B and discharged to the stacker 29 via the regular transport path 22. Assume that the roll diameter is reduced to such an extent that the height of the curl exceeds the height a. Then, the paper 11 is steered in a direction A by the separator 28 to enter the uncurling section 25. In the uncurling section 25, the paper 11 is passed through between an inner guide roller and an outer guide to be thereby uncurled. The uncurled paper 11 is discharged to the stacker 29.

The transport of the paper 11 in the direction A or B via the separator 28 is effected by the feed roller 13 of the recording section 12, i.e., such transport cannot be done once the paper 11 is cut by the cutter 16. For this reason, the minimum recording length (cutting length) is selected to be greater than the distance between the drive roller 26 located on the uncurl transport path 23 and the feed roller 13, thereby implementing the transport along the path 23 after cutting. On the other hand, the cut paper 11 on the regular transport path 22 drops onto the stacker 29 due to gravity. The drive roller 26 precedes the uncurling section 25 in order to drive the paper 11 into the section 25 while giving elasticity thereto. This is successful in insuring a transporting force overcoming a resistance ascribable to the uncurling operation. Specifically, since the uncurling section 25 uncurls the paper 11 by curling it in the opposite direction, it exerts a resistance to the transport of the paper 11. When the paper 11 is soft, the force of the feed roller 13 may be too weak to prevent a jam. The embodiment enhances reliable transport in the uncurling section 25 by the drive roller 26. Furthermore, while the paper 11 is moved in the uncurling section 25, the inner guide roller rotates and does not rub the imaged surface of the paper 11, insuring desirable image quality.

Figure 4:
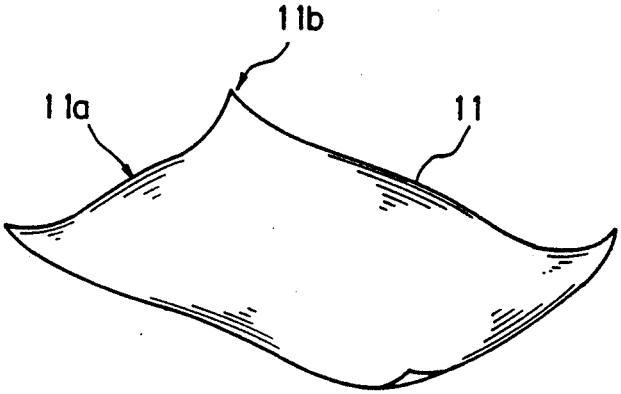
FIG. 4 shows how a paper is apt to curl.

As shown in FIG. 4, it is likely that the paper 11 has a curl which is small at the center 11*a* and maximum at four corners 11*b*. However, the embodiment is free from a jam since the triangular separator 28 selects either of the directions A and B at the center thereof and, then, the paper 11 is transported along the slants of the separator 28.

Figure 3A:
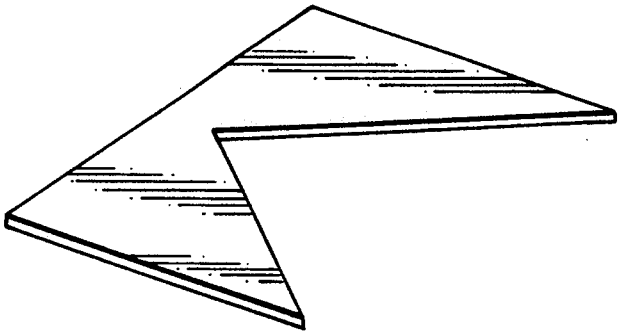
FIGS. 3A–3C each shows another specific configuration of the separator.
Figure 3B:
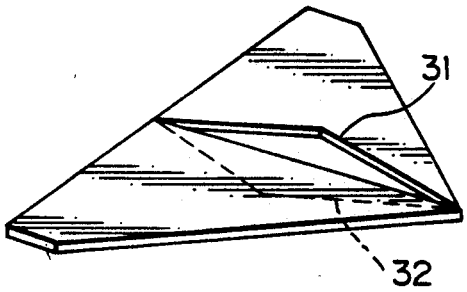
Figure 3C:
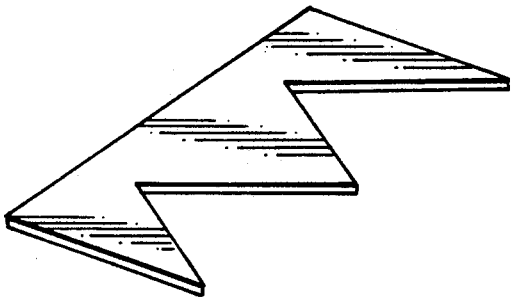

FIGS. 3A-3C each shows another specific configuration of the separator 28. In FIG. 3A, the separator is provided with a configuration derived from the fact that the curl of the paper 11 is maximum at four corners thereof. The separator of FIG. 3A is not as reliable as the separator 28 of the previous embodiment. In FIG. 3B, the separator is provided with inclinations in the up-and-down direction in addition to the inclinations in the widthwise direction. Specifically, in FIG. 3B, the separator has inclined guides 31 and 32 on opposite major surfaces thereof so as to sequentially guide the paper 11 upward or downward. The separator with such a configuration is superior to the separator 28 of the previous embodiment in respect of reliability. Further, the separator shown in FIG. 3C is the combination of the configurations of FIGS. 3A and 3B and is miniature.

As stated above, in the illustrative embodiment, the separator 28 selects either of the transport paths 22 and 23 at the center or corners thereof and thereafter sequentially orients the leading edge in the initial direction, thereby promoting reliable paper transport. Should the leading edge of the paper be wavey and abut against the separator over the entire width, it would tend to advance partly in the direction A and partly in the direction B and jam the path.

In summary, it will be seen that the present invention provides an uncurling device which uncurls a paper only when the curl of the paper is greater than predetermined one. The uncurling device does not need a curl sensor or a movable separator, which is expensive, and is therefore inexpensive. Since the degree of the curl is directly determined by a simple fixed separator, the uncurling operation is free from the influence of roll diameter, paper property, print pattern, temperature and so forth. The curling device is therefore similarly applicable to the uncurling of cut sheets. The curling device selects a particular transport path with accuracy on the basis of the height of the curl, thereby insuring an accurate uncurling procedure. Since the separator causes the paper to enter a particular transport path little by little from part of the leading edge thereof, a jam is prevented at the inlet of the path even when the leading edge of the paper is wavey. The paper is transported reliably by a force overcoming a resistance ascribable to the uncurling operation. Furthermore, slightly curled papers cut and driven out of a regular transport path, as distinguished from an uncurl transport path, are pressed from above by uncurled papers and, therefore, laid flat on a stacker, enhancing neat stacking.

Various modifications will become possible for those skilled in the art after receiving the teachings of the present disclosure without departing from the scope thereof.

What is claimed is:

1. A device for uncurling paper comprising:

means defining transport paths consisting of means for defining a first transport path and means defining a second transport path;

said means defining a first transport path including uncurling means located therealong;

a fixed separator for directing paper to one of said means for defining a first transport path and said means for defining a second transport path; and a stacking tray disposed downstream of said means defining a first transport path and said means defining a second transport path, wherein said stacking tray receives paper from said means defining a first transport path and said means defining a second transport path only up to a maximum stack height, with the stack height extending in a direction perpendicular to a stacking surface against which a lowermost sheet of a stack is disposed, said means defining a first transport path having a lower surface spaced from said stacking surface by a distance "b" in said direction perpendicular to said stacking surface, said fixed separator defining a height "a" of an inlet of said second transport path, and wherein "b" is selected to be equal to or greater than the sum of "a" and the maximum stack height.

2. The device of claim 1, further including cutting means for cutting paper from a continuous length of paper, said cutting means located upstream of said means defining transport paths, the device further including a support located downstream of said cutting means and upstream of said means defining transport paths.

3. The device of claim 2, wherein said support is inclined in a direction of movement of the paper.

4. The device of claim 1, wherein said fixed separator includes a triangular configuration.

5. The device of claim 4, wherein said triangular configuration of said separator includes a first triangular portion having an apex at a center location with respect to a widthwise direction perpendicular to a paper transport direction, said separator further including a pair of triangular portions adjacent said first triangular portion.

6. The device of claim 1, wherein said separator includes a first triangular portion disposed in a first plane extending parallel to a transport direction, with an apex of said first triangular portion located at a center with respect to a widthwise direction perpendicular to said paper transport direction, said separator further including a second triangular portion extending in a second plane perpendicular to said first plane.

7. The device of claim 1, further including cutting means for cutting paper from a continuous length into paper sheets of a predetermined length, said device further including at least one drive roller located along said means defining a first transport path and upstream of said uncurling means, said at least one drive roller spaced from said cutting means by an amount less than said predetermined length.

8. A device for uncurling paper comprising:

means defining a first transport path including uncurling means therealong;

means defining a second transport path for transporting paper without uncurling said paper;

a fixed separator for directing paper to one of said first and second transport paths;

said means defining a first transport path and said means defining a second transport path including respective first and second exits;

a stacking tray located immediately downstream of said first and second exists; and wherein said first and second exits are disposed adjacent to said stacking tray such that paper is stacked upon said stacking tray as it is discharged from said first and second exits, and further wherein as paper is stacked upon a stacking surface of said tray a stack increases in size in a first direction perpendicular to said stacking surface, and said first exit is spaced from said stacking surface in said first direction by an amount greater than a spacing between said second exit and said stacking surface, whereby paper is discharged from said first exit at a greater distance from said stacking surface than paper discharged from said second exit.

9. The device of claim 8, further including cutting means for cutting paper from a continuous length into paper sheets of a predetermined length, said device further including at least one drive roller located along said means defining a first transport path and upstream of said uncurling means, said at least one drive roller spaced from said cutting means by an amount less than said predetermined length.

* * * * *